US011191406B2

(12) United States Patent
Cho et al.

(10) Patent No.: US 11,191,406 B2
(45) Date of Patent: Dec. 7, 2021

(54) CLEANER

(71) Applicant: Samsung Electronics Co., Ltd., Suwon-si (KR)

(72) Inventors: Dong Jin Cho, Suwon-si (KR); Hyeon Woo Tak, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 318 days.

(21) Appl. No.: 16/199,828

(22) Filed: Nov. 26, 2018

(65) Prior Publication Data

US 2019/0167058 A1 Jun. 6, 2019

(30) Foreign Application Priority Data

Dec. 5, 2017 (KR) ..... 10-2017-0165776

(51) Int. Cl.

| | |
|---|---|
| ***A47L 9/24*** | (2006.01) |
| ***A47L 9/10*** | (2006.01) |
| ***A47L 9/32*** | (2006.01) |
| ***A47L 5/28*** | (2006.01) |
| ***A47L 5/24*** | (2006.01) |
| ***A47L 9/16*** | (2006.01) |
| ***A47L 9/28*** | (2006.01) |

(52) U.S. Cl.

CPC ..... *A47L 9/244* (2013.01); *A47L 5/24* (2013.01); *A47L 5/28* (2013.01); *A47L 9/102* (2013.01); *A47L 9/104* (2013.01); *A47L 9/106* (2013.01); *A47L 9/1641* (2013.01); *A47L 9/248* (2013.01); *A47L 9/2884* (2013.01); *A47L 9/322* (2013.01)

(58) Field of Classification Search

CPC ... A47L 5/24; A47L 5/28; A47L 9/102; A47L 9/104; A47L 9/106; A47L 9/1641; A47L 9/244; A47L 9/248; A47L 9/2884; A47L 9/322

See application file for complete search history.

(56) References Cited

U.S. PATENT DOCUMENTS

| | | | | |
|---|---|---|---|---|
| 2001/0025395 | A1* | 10/2001 | Matsumoto | A47L 9/20 15/353 |
| 2014/0137364 | A1 | 5/2014 | Stickney et al. | |
| 2016/0174787 | A1* | 6/2016 | Conrad | A47L 5/28 15/329 |

(Continued)

FOREIGN PATENT DOCUMENTS

| | | | |
|---|---|---|---|
| CN | 1319372 | A | 10/2001 |
| EP | 1 139 843 | A2 | 10/2001 |

(Continued)

OTHER PUBLICATIONS

International Search Report dated Apr. 2, 2019, issued in an International application No. PCT/KR2018/015207.

(Continued)

*Primary Examiner* — Marc Carlson
(74) *Attorney, Agent, or Firm* — Jefferson IP Law, LLP

(57) ABSTRACT

A cleaner for collecting dust is provided. The cleaner includes a suction head, a dust collector having a first end mounted on the suction head and including a first dust collecting chamber, an extension member slidably mounted on the dust collector at the other end opposite to the first end of the dust collector, and a first dirt removing member disposed at one end of the extension member and having elasticity.

21 Claims, 9 Drawing Sheets

(56) References Cited

U.S. PATENT DOCUMENTS

| | | | | |
|---|---|---|---|---|
| 2016/0174789 | A1* | 6/2016 | Han | A47L 9/1683 15/327.1 |
| 2016/0174795 | A1 | 6/2016 | Thorne et al. | |
| 2017/0112341 | A1 | 4/2017 | Han et al. | |
| 2019/0008337 | A1* | 1/2019 | Li | A47L 5/225 |

FOREIGN PATENT DOCUMENTS

| | | | |
|---|---|---|---|
| JP | 2013230252 | A | 11/2013 |
| KR | 10-2003-0052837 | A | 6/2003 |
| KR | 10-0880492 | B2 | 11/2006 |
| KR | 10-0880492 | B2 | 1/2009 |
| KR | 10-2015-0129562 | A | 11/2015 |
| KR | 10-2017-0046346 | A | 5/2017 |

OTHER PUBLICATIONS

European Search Report dated Sep. 14, 2020 issued in European Application No. 18887174.3.
Chinese Office Action dated Apr. 22, 2021, issued in Chinese Patent Application No. 201880078120.X.
Indian Office Action dated Jan. 29, 2021, issued in Indian Application No. 202017027876.

* cited by examiner

CLEANER

CROSS-REFERENCE TO RELATED APPLICATION(S)

This application is based on and claims priority under 35 U.S.C. § 119 of a Korean patent application number 10-2017-0165776, filed on Dec. 5, 2017 in the Korean Intellectual Property Office, the disclosure of which is incorporated by reference herein in its entirety.

BACKGROUND

1. Field

The disclosure relates to a cleaner. More particularly, the disclosure relates to a cleaner having an improved structure.

2. Description of Related Art

A cleaner is a device that cleans a room by removing rubbish or dirt from the room, and a vacuum cleaner is commonly used in a home. The vacuum cleaner suctions air using the suction force of a fan motor unit, separates dirt in the suctioned air with a device such as a filter, and thereby cleans the room. The vacuum cleaner includes a canister type and an upright type. In recent years, a robot cleaner has been popularized which runs a cleaning area by itself without a user's operation and suctions dirt such as dust from a surface to be cleaned to perform a cleaning operation.

The vacuum cleaner includes a dust collector inside so as to filter dirt by a predetermined filtering device so that the dirt contained in the suctioned air is filtered. The filtering device for filtering dirt from the dust collector includes a porous filter unit in which air is passed through a porous filter to forcibly filter dirt and a cyclone type dust collector for filtering dirt through a cyclonic flow of air.

Since dirt such as human hair or animal hair is entangled in the dust collector in the process of filtering the dirt from the vacuum cleaner and the user needs to directly separate such dust from the dust collector, the vacuum cleaner is unsanitary and troublesome to use.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide a cleaner capable of easily discharging dirt collected in a dust collector from a dust collecting chamber.

Another aspect of the disclosure is to provide a cleaner capable of preventing dirt from being scattered when a dust collecting chamber is emptied.

Another aspect of the present disclosure is to provide a cleaner having a reduced size.

Additional aspects will be set forth in part in the description which follows and, in part, will be apparent from the description, or may be learned by practice of the presented embodiments.

In accordance with an aspect of the disclosure, a cleaner is provided. The cleaner includes a suction head, a dust collector having a first end mounted on the suction head and including a first dust collecting chamber, an extension member slidably mounted on the dust collector at a second end opposite to the first end of the dust collector, and a first dirt removing member disposed at one end of the extension member and having elasticity.

The dust collector may include a filtering device disposed inside the dust collector and the filtering device is configured to filter dirt introduced through the suction head.

The first dirt removing member may be configured to be slid on one surface of the filtering device on which dirt is filtered when the extension member slidingly moves with respect to the dust collector.

The cleaner may further include a dirt separator disposed in a rear of the filtering device along a direction in which air introduced through the suction head is discharged.

The dirt separator may include a mesh member disposed inside the dust collector.

The cleaner may further include a second dirt removing member configured to be slid on one surface of the mesh member on which dirt is filtered when the extension member slidingly moves with respect to the dust collector.

The dirt separator may be configured to generate at least one cyclone, and includes a second dust collecting chamber in which the dirt separated from the at least one cyclone is collected.

The first dirt removing member may be configured to be movable from a first position between the filtering device and the dirt separator to a second position protruding outside the dust collector.

The cleaner may further include a button device configured to fix a position of the extension member with respect to the dust collector.

The cleaner may further include a fixing member, wherein the button device may include a button configured to be movable with respect to the dust collector, and wherein the fixing member is configured to fix or release the extension member with respect to the dust collector as the button is moved.

The button device may further include an elastic member for pressing the button to a fixing position so that the extension member is fixed with respect to the dust collector.

The cleaner may further include a handle device disposed at the second end of the extension member opposite to one end of the extension member connected to the dust collector, and a fan motor disposed inside the handle device for generating a suction force.

The cleaner may further include a filter disposed in front of the fan motor along a direction in which air introduced into the handle device is discharged.

The cleaner may further include a cover, wherein the dust collector may include an opening/closing member having a chamber inlet through which air introduced from the suction head passes and configured to open and close the first dust collecting chamber, and wherein the cover is configured to open and close the chamber inlet, and open the chamber inlet in a direction in which air is introduced into the first dust collecting chamber.

The dust collector may include an outer case and an inner case disposed inside the outer case to form a passage between the inner case and the outer case, and the filtering device may be mounted on the inner case.

In accordance with another aspect of the disclosure, a cleaner is provided. The cleaner includes a dust collector including a first dust collecting chamber, an extension member slidably mounted on the dust collector at a first end of the dust collector, a filtering device disposed inside the dust collector and for filtering dirt, and a first dirt removing member configured to be slid on one surface of the filtering device on which the dirt is filtered when the extension member slidingly moves with respect to the dust collector.

The cleaner may further include a dirt separator disposed in a rear of the filtering device along a direction in which air passing through the filtering device is discharged.

The first dirt removing member may be movable from a first position between the filtering device and the dirt separator to a second position protruding outside the dust collector.

The cleaner may further include a fixing member disposed to fix or release the extension member with respect to the dust collector, and a button for guiding a movement of the fixing member.

In accordance with another aspect of the disclosure, a cleaner is provided. The cleaner includes a suction head, a dust collector having a first end mounted on the suction head and including a first dust collecting chamber, an extension member slidably mounted on the dust collector at a second end opposite to the first end of the dust collector, a filtering device disposed inside the dust collector and configured to filter dirt, a first dirt removing member disposed in the extension member and configured to be slid in a state of being in close contact with the filtering device when the extension member slidingly moves with respect to the dust collector, and a dirt separator disposed in a rear of the filtering device along a direction in which air introduced through the suction head is discharged.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, like reference numerals will be understood to refer to like parts, components, and structures.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Like reference numbers or designations in the various figures of the disclosure represent parts or components that perform substantially the same functions.

The terms "comprises" and "has" are intended to indicate that there are features, numbers, operations, elements, parts, or combinations thereof described in the specification, and do not exclude the presence or addition of one or more other features, numbers, operations, elements, parts, or combinations thereof.

It will be understood that, although the terms first, second, etc. may be used herein to describe various components, these components should not be limited by these terms. These terms are only used to distinguish one component from another. For example, without departing from the scope of the disclosure, the first component may be referred to as a second component, and similarly, the second component may also be referred to as a first component. The term "and/or" includes any combination of a plurality of related items or any one of a plurality of related items.

A dust collector and an extension member of the disclosure may be applied to a handy type cleaner, a stick type cleaner, a handy-stick type cleaner, or the like. Hereinafter, a case in which the dust collector and the extension member are applied to the stick-type cleaner will be described as an embodiment of the disclosure.

Hereinafter, various embodiments according to the disclosure will be described in detail with reference to the accompanying drawings.

Figure 1:
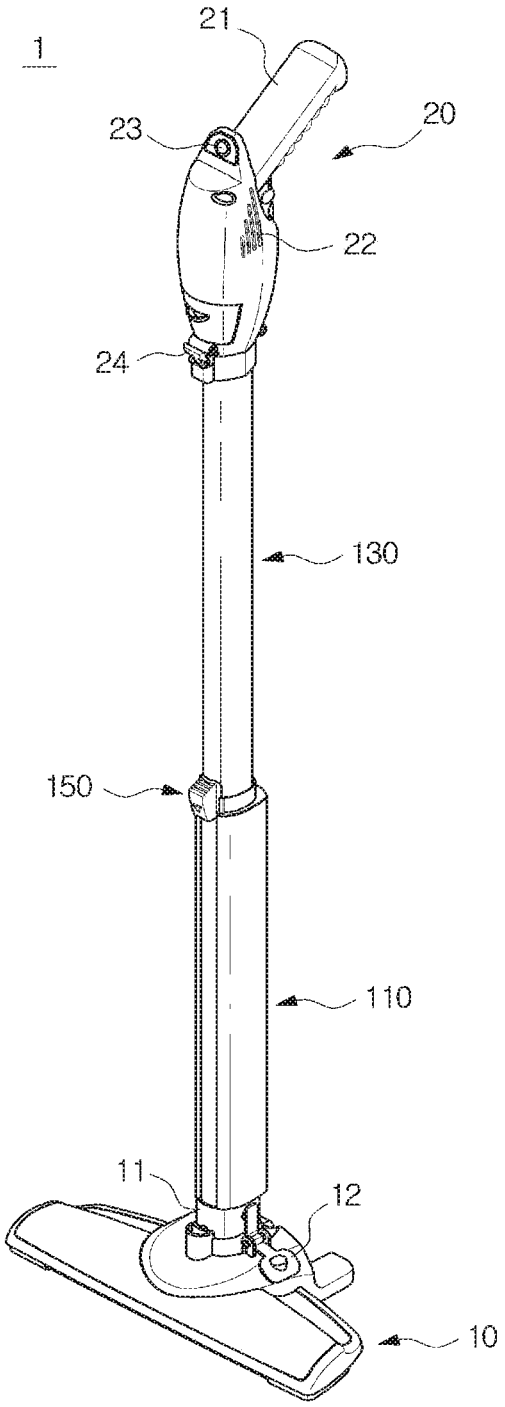
FIG. 1 is a perspective view of a cleaner according to an embodiment of the disclosure.
Figure 2:
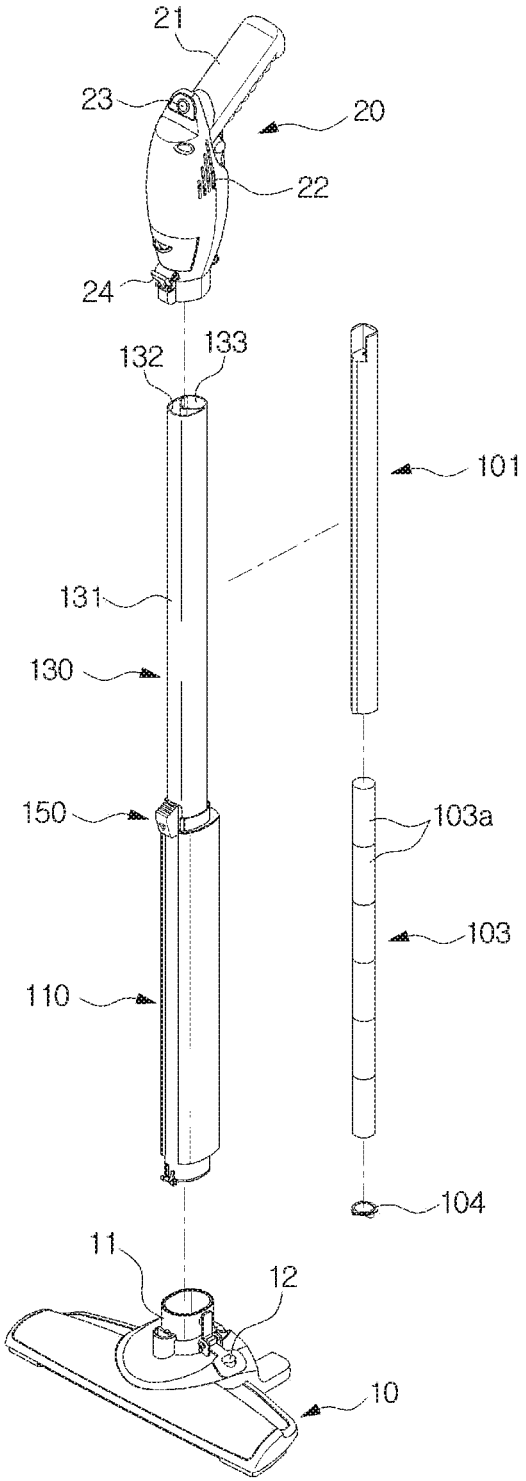
FIG. 2 is an exploded view of the cleaner shown in FIG. 1 according to an embodiment of the disclosure.
Figure 3:
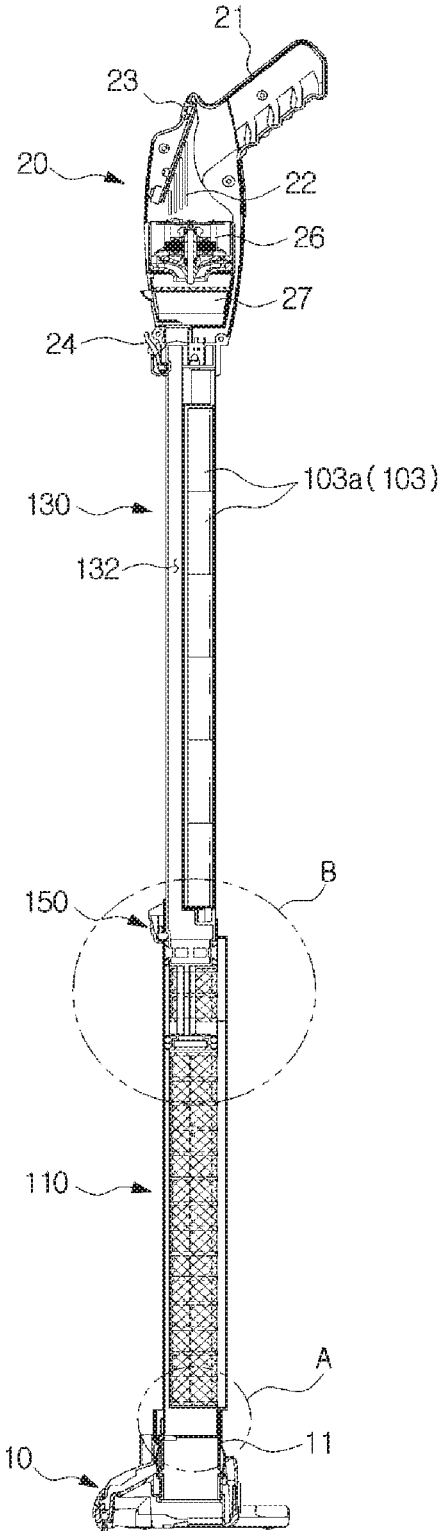
FIG. 3 is a cross-sectional view of the cleaner shown in FIG. 1 according to an embodiment of the disclosure.

FIG. 1 is a perspective view of a cleaner according to an embodiment of the disclosure, FIG. 2 is an exploded view of the cleaner shown in FIG. 1 according to an embodiment of the disclosure, and FIG. 3 is a cross-sectional view of the cleaner shown in FIG. 1 according to an embodiment of the disclosure.

Referring to FIGS. 1, 2 and 3, a cleaner 1 according to an embodiment of the disclosure will be described below. The cleaner 1 may include a suction head 10 configured to suction dirt such as hair on a surface to be cleaned by an air suction force, a dust collector 110 configured to collect the dirt suctioned through the suction head 10, an extension member 130 slidably coupled to the dust collector 110, and a handle device 20 coupled to the extension member 130 to be grasped by a user.

The suction head 10 moves on the surface to be cleaned and suctions dirt such as dust present on the surface to be cleaned. The suction head 10 may be rotatably connected to a lower end portion of the dust collector 110. An air passage may be formed in the suction head 10. The air passage formed inside the suction head 10 may communicate with the dust collector 110 through a neck portion 11. Accordingly, the external air and dirt, etc., introduced through the suction head 10 may be introduced into the dust collector 110 through the neck portion 11.

The suction head 10 may include a head switch 12 for fixing or releasing the state in which the suction head 10 is engaged with the dust collector 110. The head switch 12 may fix the position of the dust collector 110 with respect to the suction head 10 by pressing an end portion of the dust collector 110 coupled to the neck portion 11 of the suction head 10. When the user desires to separate the dust collector 110 from the suction head 10, the user may press the head switch 12 to release the pressing of the dust collector 110, and then remove the dust collector 110. As the head switch 12 is disposed on the suction head 10, the user may separate the dust collector 110 from the suction head 10 by pressing the head switch 12 using his/her foot without bending his/her waist.

The handle device 20 may include a gripping portion 21. The gripping portion 21 may be disposed on an upper end portion of the cleaner 1 so that the user may easily grasp the gripping portion 21. When using the cleaner 1, the user may push or pull the suction head 10 in a state where the user grasps the gripping portion 21.

An outlet 22 formed of a plurality of discharge holes may be provided on at least one side surface of the handle device 20. The outlet 22 may be formed to discharge the filtered air. The position where the outlet 22 is formed is not limited to the side surface of the handle device 20 but may be formed on the front surface and/or the rear surface of the handle device 20.

The handle device 20 may be provided with an operation switch 23 for adjusting an operation level of the cleaner 1. The operation switch 23 is provided to receive the intention of the user as to whether the cleaner 1 is operating or not. The operation switch 23 may be disposed in front of the handle device 20 so that the user may move and operate the cleaner 1 when cleaning is performed.

The handle device 20 may include an extension member fixing unit 24 for fixing the extension member 130 inserted in the handle device 20. The extension member fixing unit 24 may fix the extension member 130 to the handle device 20 by pressing an end of the extension member 130 when the end of the extension member 130 is inserted into the handle device 20. When the user wishes to separate the handle device 20 from the extension member 130, the user presses the extension member fixing unit 24 to release the extension member 130 and then separates the handle device 20 from the extension member 130.

The handle device 20 may be provided with a fan motor unit 26 for generating a suction force necessary for suctioning dirt on the surface to be cleaned. The fan motor unit 26 may be provided to suction the outside air through the suction head 10 and discharge the suctioned air to the outlet 22. The fan motor unit 26 may be disposed inside the handle device 20.

A filter 27 may be disposed inside the handle device 20 to once more filter the dirt in the air before the air is introduced into the fan motor unit 26. The filter 27 may be disposed in front of the fan motor unit 26 along a direction in which the air introduced into the handle device 20 is discharged through the outlet 22. However, the position of the filter 27 is not limited thereto. For example, the filter 27 may be disposed inside the extension member 130. The filter 27 may filter dirt from the air that has passed through a filtering device 113, which will be described later.

An end portion of the dust collector 110 may be mounted on the suction head 10. The dust collector 110 may include an outer case 111 and an inner case 112 disposed inside the outer case 111.

The outer case 111 may form a part of the outer shape of the cleaner 1. A first dust collecting chamber 110*a* may be formed inside the outer case 111. The first dust collecting chamber 110*a* may collect the filtered dirt when the air introduced through the suction head 10 passes through the filtering device 113.

The inner case 112 will be described later.

One end of the extension member 130 may be connected to the dust collector 110 and the other end of the extension member 130 may be connected to the handle device 20. The extension member 130 may be slidably coupled to the dust collector 110. The extension member 130 may form a part of the outer shape of the cleaner 1.

The extension member 130 may include an extension case 131. The inside of the extension case 131 may form an extension passage 132. The extension passage 132 may guide air having passed through the dust collector 110 to the handle device 20.

The extension case 131 may include a battery mounting portion 133. The battery mounting portion 133 may be provided to be partitioned from the extension passage 132. The battery unit 103 (e.g., a battery) may be mounted on the battery mounting portion 133. The battery unit 103 may include at least one battery 103*a*.

The battery unit 103 may be mounted on the battery mounting portion 133 in a state of being mounted in the battery case 101. The battery case 101 may be provided to accommodate the battery unit 103. The battery case 101 may include a battery cover 104 that closes a battery loading port (not shown) to prevent the accommodated battery unit 103 from being detached. The battery case 101 may be mounted on the extension member 130.

The battery cover 104 may include a fixing protrusion 104*a* fixed to a fixing groove 133*a* of the extension member 130.

Figure 4:
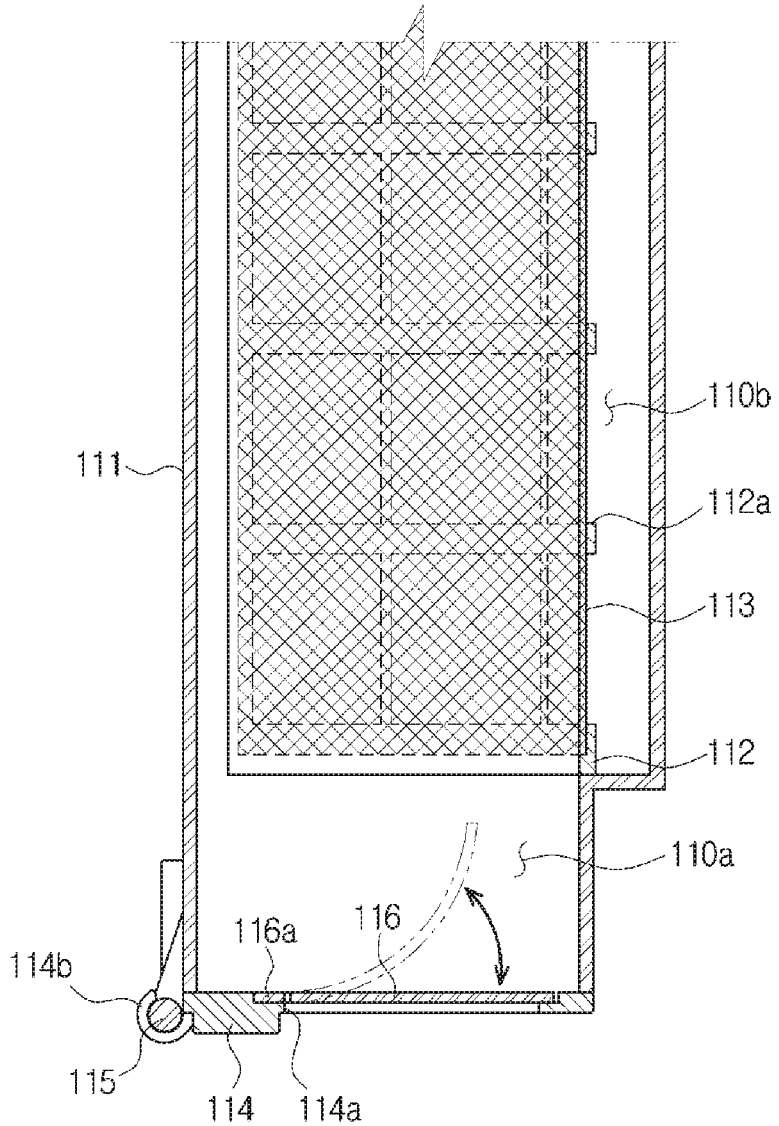
FIG. 4 is an enlarged view of a portion A shown in FIG. 3 according to an embodiment of the disclosure.
Figure 5:
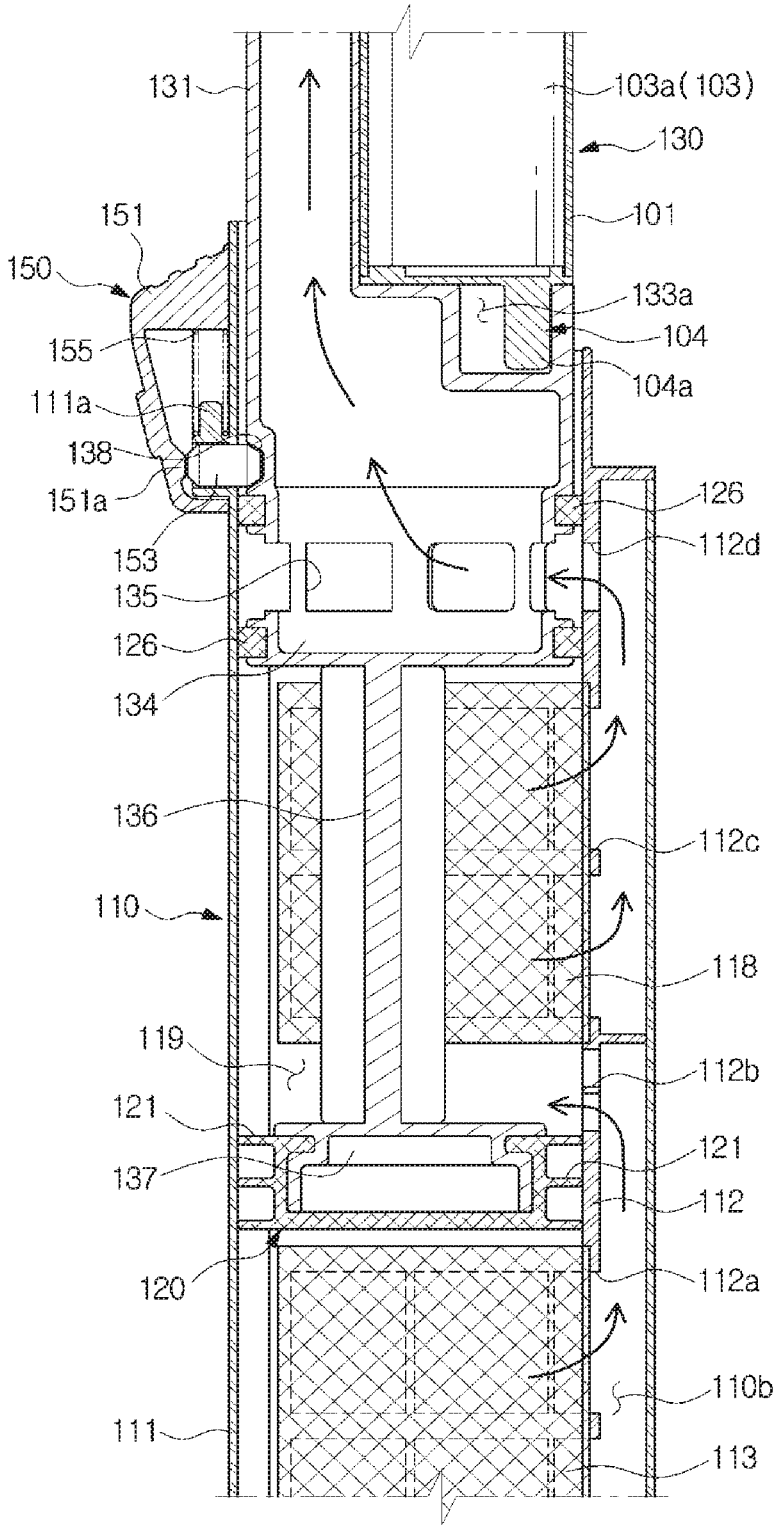
FIG. 5 is an enlarged view of a portion B shown in FIG. 3 according to an embodiment of the disclosure.

FIG. 4 is an enlarged view of a portion A shown in FIG. 3, and FIG. 5 is an enlarged view of a portion B shown in FIG. 3 according to various embodiments of the disclosure.

Referring to FIGS. 4 and 5, hereinafter, the dust collector 110 and the extension member 130 will be described in detail.

The dust collector 110 may include the inner case 112 disposed inside the outer case 111. A case passage 110*b* may be formed between the inner case 112 and the outer case 111. The case passage 110*b* may guide the air that has passed through the filtering device 113 to a second dust collecting chamber 119.

The inner case 112 may include a first case opening 112*a* formed so that air passing through the filtering device 113 may flow to the case passage 110*b*. The filtering device 113 may be disposed to cover a portion of the inner case 112 in which the first case opening 112*a* is formed.

The inner case 112 may include a second case opening 112*b* through which air guided through the case passage 110*b* flows into the second dust collecting chamber 119.

The air introduced into the second dust collecting chamber 119 through the second case opening 112*b* may be secondarily filtered by a dirt separator 118. The dirt separator 118 may be provided as a mesh member. The dirt separator 118 may be disposed inside the dust collector 110. The dirt separator 118 may be disposed inside the second dust collecting chamber 119. The dirt filtered by the dirt separator 118 may be collected in the second dust collecting chamber 119.

The inner case 112 may include a third case opening 112*c* and a fourth case opening 112*d* for guiding the air filtered in the second dust collecting chamber 119 to the extension passage 132 of the extension member 130. The air in the second dust collecting chamber 119 may be secondarily filtered by passing through the dirt separator 118, sequentially pass through the third case opening 112*c* and the fourth case opening 112*d*, and then move to the extension member 130.

The dust collector 110 may include the filtering device 113 disposed inside the dust collector 110. The filtering device 113 is capable of firstly filtering dirt from the air introduced through the suction head 10. The filtering device 113 may be disposed along an inner surface of the inner case 112. The dirt filtered by the filtering device 113 may be collected in the first dust collecting chamber 110*a*. The filtering device 113 may be provided as a mesh member.

The dust collector 110 may include an opening/closing member 114 provided at an end portion connected to the suction head 10. The opening/closing member 114 may be configured to open and close the first dust collecting chamber 110*a*. The opening/closing member 114 may include a chamber inlet 114*a* through which air introduced from the suction head 10 is introduced into the first dust collecting chamber 110*a*.

The opening/closing member 114 may be rotatably coupled to a shaft 115 of the dust collector 110 and may be rotationally driven with the shaft 115 as a rotational axis. The opening/closing member 114 may include a shaft coupling portion 114*b* that is rotatably coupled to the shaft 115.

The chamber inlet 114*a* of the opening/closing member 114 may be opened and closed by a cover 116. The cover 116 may be configured to include a material having elasticity. The cover 116 may be provided to open the chamber inlet 114*a* in a direction in which air is introduced into the first dust collecting chamber 110*a* but not in the opposite direction. That is, the cover 116 may open the chamber inlet 114*a* when the cleaner 1 suctions dirt on the surface to be cleaned, but may not open the chamber inlet 114*a* in a direction in which dust is discharged from the first dust collecting chamber 110*a*. Accordingly, dust and dirt may be prevented from being scattered even when the dust collector 110 is separated from the suction head 10.

The cover 116 may include a fixed portion 116*a* fixed to the opening/closing member 114. When the fan motor unit 26 generates a suction force, the cover 116 may be elastically deformed to open the chamber inlet 114*a* in a state where the fixed portion 116*a* is fixed. When the fan motor unit 26 does not generate a suction force, the cover 116 may return to the position where the chamber inlet 114*a* is closed by an elastic force.

The extension member 130 may include a first mounting portion 137 that is disposed at an end portion of the extension case 131. A first dirt removing member 120 may be mounted on the first mounting portion 137. The first mounting portion 137 may extend from a second mounting portion 134 on which a second dirt removing member 126 is mounted toward the suction head 10.

The extension member 130 may include a connecting portion 136 connecting the first mounting portion 137 and the second mounting portion 134. The connecting portion 136 may be disposed in the second dust collecting chamber 119.

The second dirt removing member 126 may be mounted on the second mounting portion 134. The second mounting portion 134 may be provided with at least one extension member opening 135 into which air having passed through the dust collector 110 is introduced. The at least one extension member opening 135 may be formed along a circumference of the second mounting portion 134. Air introduced into the extension member 130 through the extension member opening 135 may be guided to the handle device 20 by the extension passage 132.

The first dirt removing member 120 may be mounted on the first mounting portion 137 of the extension member 130. The first dirt removing member 120 may be disposed at an end portion of the extension member 130. The first dirt removing member 120 may be configured to include a material having elasticity. The first dirt removing member 120 may include a tight contacting portion 121 protruding toward an inner wall of the dust collector 110. The tight contacting portion 121 may be configured to include a material having elasticity. The tight contacting portion 121 may be in close contact with an inner wall of the filtering device 113.

The first dirt removing member 120 may be provided to be in close contact with a surface of the filtering device 113 where dirt is filtered. When the extension member 130 slidingly moves relative to the dust collector 110, the first dirt removing member 120 may slidingly move in a state of being in close contact with the inner surface of the filtering device 113. When the extension member 130 slidingly moves into the dust collector 110, the first dirt removing member 120 may scrape the inner surface of the filtering device 113 and remove dirt such as hair tangled in the inner surface of the filtering device 113.

The first dirt removing member 120 may move from a first position between the filtering device 113 and the dirt separator 118 to a second position protruding outside the dust collector 110. Accordingly, the first dirt removing member 120 may discharge the dirt existing in the first dust collecting chamber 110*a* to the outside. In addition, as the first dirt removing member 120 protrudes to the outside of the dust collector 110, the dust collected in the second dust collecting chamber 119 may also be discharged to the outside.

The second dirt removing member 126 may be mounted on the second mounting portion 134 of the extension member 130. The second dirt removing member 126 may be configured to include a material having elasticity. The second dirt removing member 126 may be provided to slidingly move in a state of being in close contact with the dirt separator 118 when the extension member 130 slidingly moves relative to the dust collector 110. The second dirt removing member 126 may be provided to slide on one surface of the dirt separator 118 on which the dirt is filtered. When the extension member 130 slidingly moves relative to the dust collector 110, the second dirt removing member 126 may slide on the inner surface of the dirt separator 118 and remove dirt existing on the inner surface of the dirt separator 118.

The cleaner 1 may further include a button device 150 configured to fix the position of the extension member 130 with respect to the dust collector 110. The button device 150 may fix or release the position of the extension member 130. The button device 150 may include a button 151, a fixing member 153, and an elastic member 155.

The button 151 may be disposed on an outer wall of the dust collector 110 and may be provided to be movable relative to the dust collector 110. When it is desired to remove the dust in the dust collector 110 by sliding the extension member 130 relative to the dust collector 110, the user may press the button 151. The button 151 may include a pressing portion 151*a* for pressing the fixing member 153 so that the fixing member 153 may be inserted into an insertion groove 138 of the extension member 130.

The button 151 may be elastically biased to a position for pressing the fixing member 153 by the elastic member 155. Accordingly, when the fixing member 153 is inserted again into the insertion groove 138 by sliding the extension member 130 in the direction in which the extension member 130 is drawn out with respect to the dust collector 110 after the dust inside the dust collector 110 is discharged, the button 151 may be returned to the original position by the elastic member 155.

The fixing member 153 may fix or release the extension member 130 with respect to the dust collector 110 as the button 151 moves.

The elastic member 155 may elastically bias the button 151 to the fixing position so that the extension member 130 is fixed with respect to the dust collector 110. One end of the elastic member 155 may be fixed to a button fixing portion 111*a* of the outer case 111 and the other end may be fixed to the button 151.

According to the above-described configuration, when the cleaner 1 according to the embodiment of the disclosure performs the cleaning operation, the air containing the dirt introduced from the suction head 10 may be firstly filtered in the filtering device 113 of the first dust collecting chamber 110*a*. Then, the air that has moved to the second dust collecting chamber 119 through the case passage 110*b* may be secondarily filtered in the dust separator 118. The air that has passed through the dirt separator 118 may sequentially pass through the third case opening 112*c* and the fourth case opening 112*d*, and then may be discharged to the outside through the extension passage 132 of the extension member 130 and the outlet 22 of the handle device 20. At this time, the air may be thirdly filtered in the filter 27 of the handle device 20.

Figure 6:
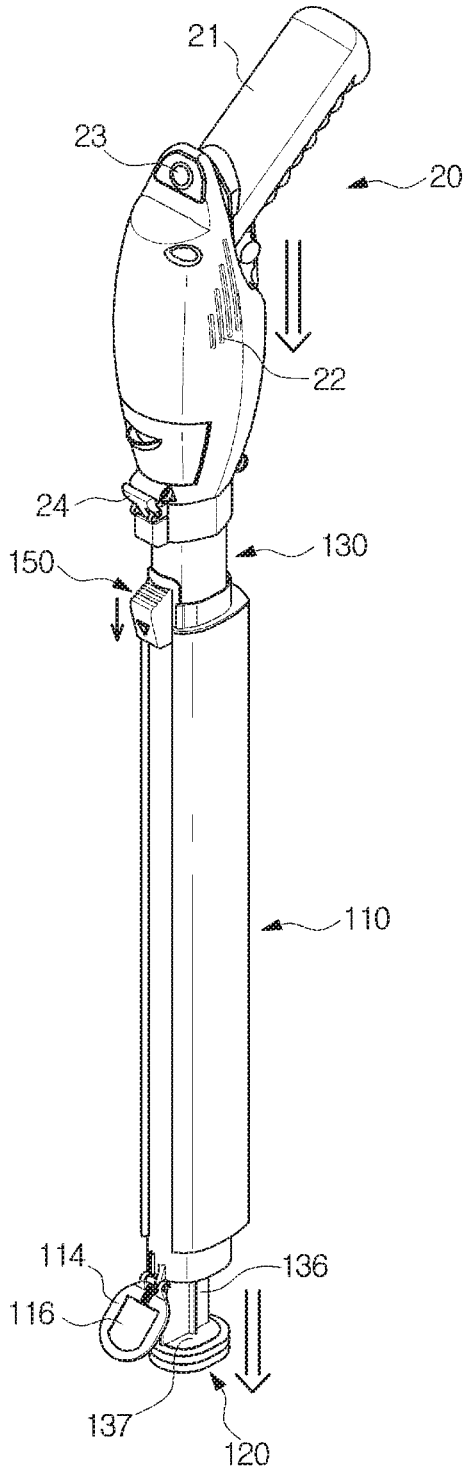
FIG. 6 is a view showing a process of emptying dust in a dust collector of the cleaner shown in FIG. 1 according to an embodiment of the disclosure.
Figure 7:
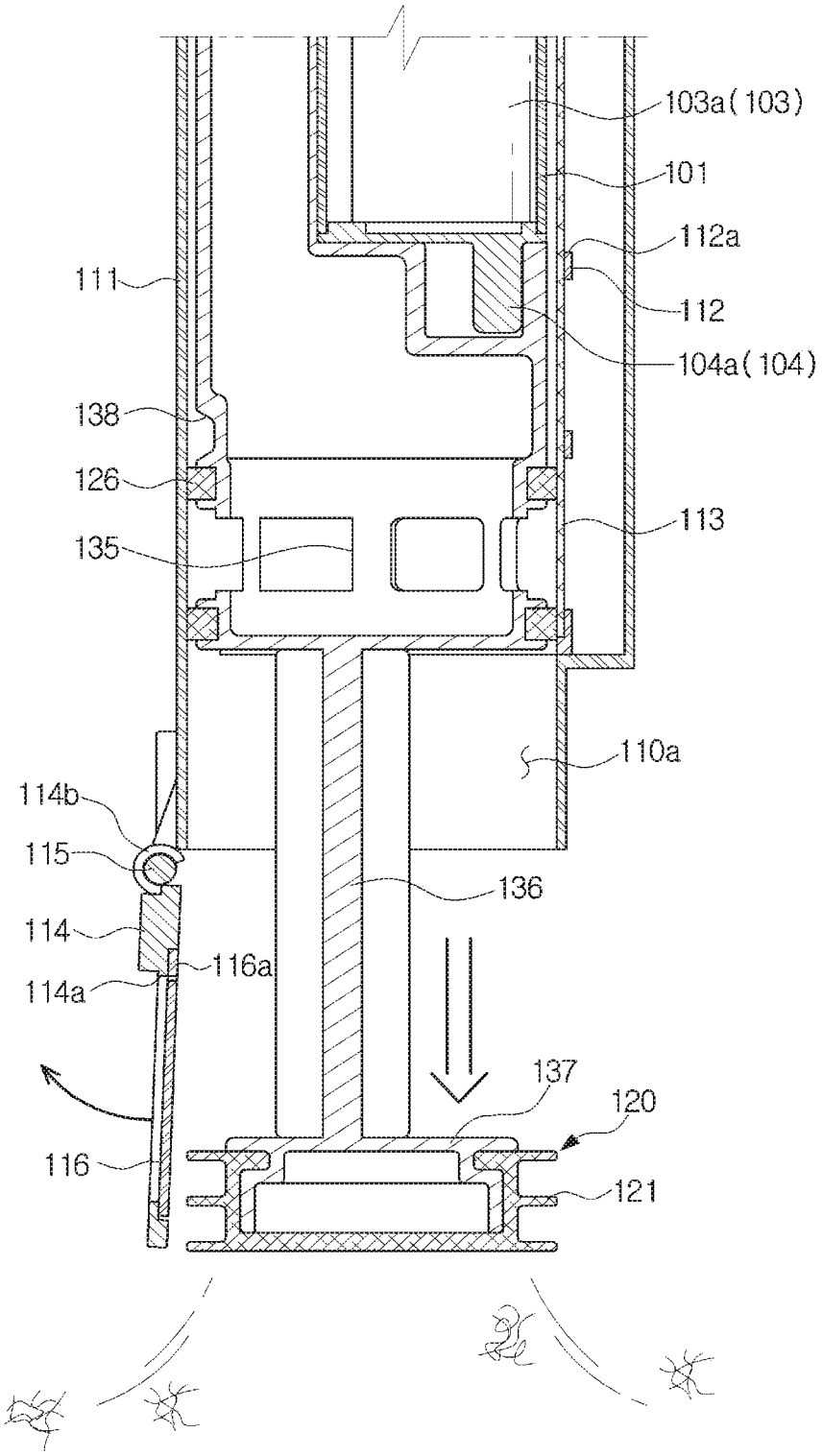
FIG. 7 is a cross-sectional view of an end portion of the dust collector and an extension member of the cleaner shown in FIG. 6 according to an embodiment of the disclosure.
Figure 8:
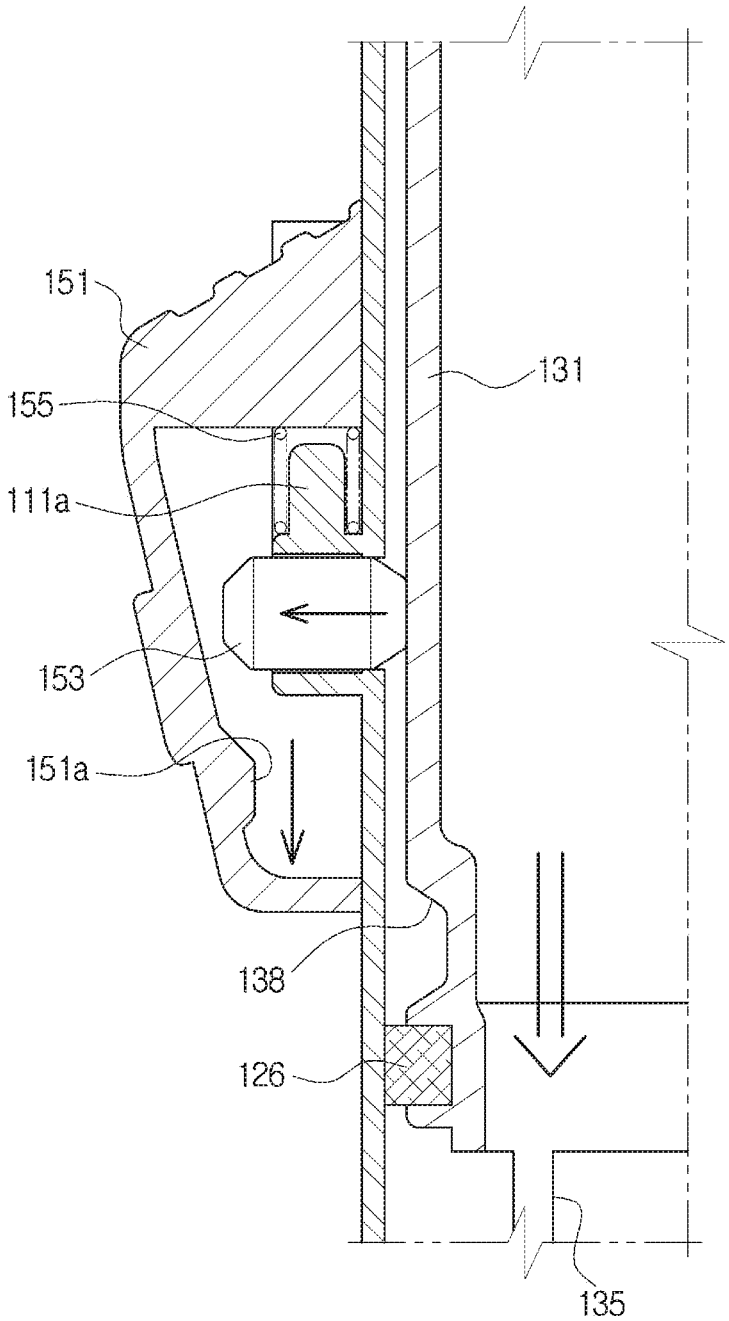
FIG. 8 is a cross-sectional view of a button device of the cleaner shown in FIG. 6 according to an embodiment of the disclosure.

FIG. 6 is a view showing a process of emptying dust in a dust collector of the cleaner shown in FIG. 1, FIG. 7 is a cross-sectional view of an end portion of the dust collector and an extension member of the cleaner shown in FIG. 6, and FIG. 8 is a cross-sectional view of a button device of the cleaner shown in FIG. 6 according to various embodiments of the disclosure.

Referring to FIGS. 6, 7 and 8, when the dust collected in the dust collector 110 is to be emptied after finishing the cleaning work, the user may press the handle device 20 and the extension member 130 to cause the extension member 130 to slidingly move within the dust collector 110. At this time, the user may press the button 151 to move the extension member 130. As the button 151 is pressed, a space in which the fixing member 153 may move is formed inside the button 151. In this state, when the user exerts a force on the extension member 130, the fixing member 153 is disengaged from the insertion groove 138 and moves toward the button 151. Thus, the extension member 130 may be slidingly moved into the dust collector 110.

When the extension member 130 slidingly moves in the dust collector 110, the first dirt removing member 120 disposed at one end of the extension member 130 may slide on one surface of the filtering device 113 disposed inside the dust collector 110 where dirt is present. The first dirt removing member 120 may slide on the one surface of the filtering device 113 and separate the dirt present in the filtering device 113 from the filtering device 113 and discharge the dirt to the outside of the dust collector 110. To this end, the first dirt removing member 120 may be moved to a position where it protrudes to the outside of the dust collector 110.

At this time, the opening/closing member 114 may open the first dust collecting chamber 110*a* as the opening/closing member 114 is pressed by the first dirt removing member 120. The opening/closing member 114 may be elastically biased in the direction of closing the first dust collecting chamber 110*a* by an elastic member (not shown).

When the extension member 130 slidingly moves in the dust collector 110, the second dirt removing member 126 disposed in the extension member 130 may slide in a state of being in close contact with the dirt separator 118 and separate the dirt existing in the dirt separator 118 from the dirt separator 118. The second dirt removing member 126 having passed through the dirt separator 118 may slide in a state of being in close contact with the inner surface of the filtering device 113 as the extension member 130 continues to move. The dirt separated from the dirt separator 118 and the filtering device 113 by the second dirt removing member 126 may be discharged to the outside as the second dust collecting chamber 119 is exposed to the outside. That is, the second dust collecting chamber 119 disposed between the first dirt removing member 120 and the second dirt removing member 126 may be exposed to the outside as the first dirt removing member 120 protrudes to the outside of the dust collector 110.

According to the above configuration, the cleaner 1 according to the embodiment of the disclosure may easily empty the dirt in the dust collector 110 by a simple operation. In addition, the cleaner 1 according to the embodiment of the disclosure may prevent the dirt from being scattered even when the dust collector 110 is separated from the suction head 10 by the opening/closing member 114.

Figure 9:
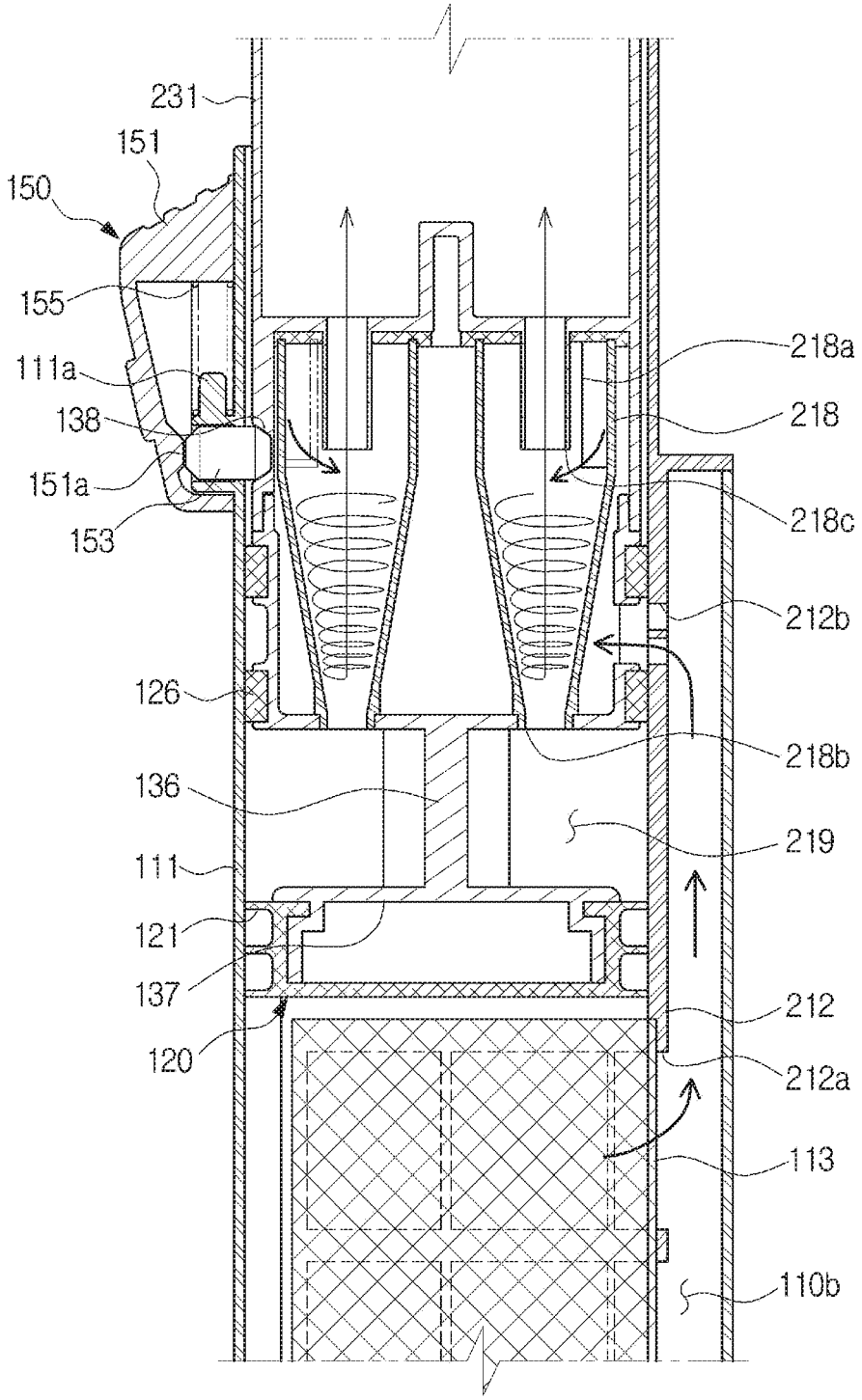
FIG. 9 is a partial cross-sectional view of a cleaner according to an embodiment of the disclosure.

FIG. 9 is a partial cross-sectional view of a cleaner according to an embodiment of the disclosure. Hereinafter, the contents overlapping with those described with reference to FIGS. 1 to 8 will be omitted.

Referring to FIG. 9, a dirt separator 218 may generate at least one cyclone. That is, in the first dust collecting chamber 110*a*, dirt in the air is filtered through the filtering device 113, but in a second dust collecting chamber 219, dust may be centrifugally separated from the air using the at least one cyclone.

The air that has passed through the filtering device 113 may pass through a first case opening 212*a* and a second case opening 212*b* of an inner case 212 and may be introduced into the second dust collecting chamber 219. The air introduced into the second dust collecting chamber 219 may flow into the dirt separator 218 through at least one cyclone opening 218*a*, the dirt in the introduced air may be centrifuged from the air and collected in the second dust collecting chamber 219 through a dust collecting opening 218*b*, and the air may be moved to the inside of an extension case 231 through an air passing hole 218*c*.

As is apparent from the above, the cleaner according to the disclosure can easily discharge the dirt collected in the dust collector from the dust collecting chamber since the first dust removing member disposed on the extension member separates the dirt attached to one surface of the filtering device as the extension member is slidingly moved with respect to the dust collector.

Further, the cleaner according to the disclosure can prevent dirt from being scattered when the dust collecting chamber is emptied since the dust collecting chamber is opened when the first dirt removing member is protruded to the outside of the dust collector by slidingbly moving the extension member after separating the dust collector from the suction head.

Further, the cleaner according to the disclosure can have a reduced size since the configuration is relatively simple.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A cleaner comprising:

a suction head;

a dust collector comprising:

a first end mounted on the suction head, and a first dust collecting chamber;

an extension member slidably mounted on the dust collector, a second end of the extension member being detachably fixed to a handle device of the cleaner and a first end of the extension member being mounted on the dust collector at a second end of the dust collector opposite to the first end of the dust collector, the extension member being movable relative to the dust collector; and a first dirt removing member disposed at the first end of the extension member and having elasticity, wherein, in case the extension member is slidably moved relative to the dust collector and the first dirt removing member is moved to a position protruding from the dust collector, the first dirt removing member detaches dirt accumulated on the first dust collecting chamber and discharges the separated dirt to an outside of the dust collector.

2. The cleaner according to of claim 1, wherein the dust collector further comprises a filtering device disposed inside the dust collector, and wherein the filtering device is configured to filter dirt introduced through the suction head.

3. The cleaner of claim 2, wherein the first dirt removing member is configured to be slid on one surface of the filtering device on which dirt is filtered in case the extension member slidingly moves with respect to the dust collector.

4. The cleaner of claim 2, further comprising a dirt separator disposed in a rear of the filtering device along a direction in which air introduced through the suction head is discharged.

5. The cleaner of claim 4, wherein the dirt separator comprises a mesh member disposed inside the dust collector.

6. The cleaner of claim 5, further comprising a second dirt removing member configured to be slid on one surface of the mesh member on which dirt is filtered in case the extension member slidingly moves with respect to the dust collector.

7. The cleaner of claim 4, wherein the dirt separator is configured to generate at least one cyclone, and wherein the dirt separator comprises a second dust collecting chamber in which dirt separated from the at least one cyclone is collected.

8. The cleaner of claim 4, wherein the first dirt removing member is configured to be movable from a first position between the filtering device and the dirt separator to a second position protruding outside the dust collector.

9. The cleaner of claim 2, wherein the dust collector further comprises an outer case and an inner case disposed inside the outer case to form a passage between the inner case and the outer case, and wherein the filtering device is mounted on the inner case.

10. The cleaner of claim 1, further comprising a button device configured to fix a position of the extension member with respect to the dust collector.

11. The cleaner of claim 10, further comprising:

a fixing member, wherein the button device comprises a button configured to be movable with respect to the dust collector, and wherein the fixing member is configured to at least one of fix or release the extension member with respect to the dust collector based on movement of the button.

12. The cleaner of claim 11, wherein the button device further comprises an elastic member configured to press the button to a fixing position thereby fixing the extension member with respect to the dust collector.

13. The cleaner of claim 1, further comprising a fan motor disposed inside the handle device and configured to generate a suction force.

14. The cleaner of claim 13, further comprising a filter disposed in front of the fan motor along a direction in which air introduced into the handle device is discharged.

15. The cleaner of claim 1, further comprising:

a cover, wherein the dust collector further comprises an opening/closing member having a chamber inlet through which air introduced from the suction head passes and configured to open and close the first dust collecting chamber, and wherein the cover is configured to:

open and close the chamber inlet, and open the chamber inlet in a direction in which air is introduced into the first dust collecting chamber.

16. The cleaner of claim 1, wherein the extension member forms a part of an outer shape of the cleaner.

17. A cleaner comprising:

a dust collector comprising:

a first dust collecting chamber, and a filtering device configured to filter dirt, the filtering device being disposed inside the dust collector;

an extension member slidably mounted on the dust collector, a second end of the extension member being detachably fixed to a handle device of the cleaner and a first end of the extension member being mounted on the dust collector at a first end of the dust collector, the extension member being movable relative to the dust collector; and a first dirt removing member disposed at the extension member, wherein, in case the extension member is slidably moved relative to the dust collector and the first dirt removing member is moved to a position protruding from the dust collector, the first dirt removing member detaches dirt accumulated on the filtering device and discharges the separated dirt to an outside of the dust collector.

18. The cleaner of claim 17, further comprising a dirt separator disposed in a rear of the filtering device along a direction in which air passing through the filtering device is discharged.

19. The cleaner of claim 18, wherein the first dirt removing member is movable from a first position between the filtering device and the dirt separator to a second position protruding outside the dust collector.

20. The cleaner of claim 17, further comprising:

a fixing member disposed to fix or release the extension member with respect to the dust collector; and a button configured to guide a movement of the fixing member.

21. A cleaner comprising:

a suction head;

a dust collector comprising:

a first end mounted on the suction head, and a dust collecting chamber;

an extension member slidably mounted on the dust collector, a second end of the extension member being detachably fixed to a handle device of the cleaner and a first end of the extension member being mounted on the dust collector at a second end of the dust collector opposite to the first end of the dust collector, the extension member being movable relative to the dust collector;

a filtering device disposed inside the dust collector and configured to filter dirt;

a dirt removing member disposed in the extension member, the dirt removing member being configured to slide in close contact with the filtering device to detach dirt accumulated on the filtering device and discharge the separated dirt to an outside of the dust collector, in case the extension member is slidingly moved with respect to the dust collector and the dirt removing member is moved to a position protruding from the dust collector; and a dirt separator disposed in a rear of the filtering device along a direction in which air introduced through the suction head is discharged.

* * * * *